US012202036B1

(12) United States Patent
Wu et al.

(10) Patent No.: US 12,202,036 B1
(45) Date of Patent: Jan. 21, 2025

(54) SYSTEM AND METHOD FOR CENTRIFUGAL INTRUSION OF MOLTEN METAL INTO POROUS MEDIA AND THEN SOLIDIFICATION POSITIONING

(71) Applicants: CHINA UNIVERSITY OF MINING AND TECHNOLOGY, Xuzhou (CN); JIANGSU RESEARCH INSTITUTE OF BUILDING SCIENCE CO., LTD., Nanjing (CN); JIANGSU SOBUTE NEW MATERIALS CO., LTD., Nanjing (CN); HUNAN XIANGYI LABORATORY INSTRUMENT DEVELOPMENT CO., LTD., Changsha (CN)

(72) Inventors: Jiangyu Wu, Xuzhou (CN); Dan Ma, Xuzhou (CN); Qian Yin, Xuzhou (CN); Weiqiang Chen, Xuzhou (CN); Hao Zhang, Nanjing (CN); Wen Xu, Nanjing (CN); Hongwen Jing, Xuzhou (CN); Bo Meng, Xuzhou (CN); Yurong Wu, Changsha (CN); Jihuai Wen, Changsha (CN); Gaofang Zhu, Xuzhou (CN); Qingbin Meng, Xuzhou (CN)

(73) Assignees: CHINA UNIVERSITY OF MINING AND TECHNOLOGY, Xuzhou (CN); JIANGSU RESEARCH INSTITUTE OF BUILDING SCIENCE CO., LTD., Nanjing (CN); JIANGSU SOBUTE NEW MATERIALS CO., LTD., Nanjing (CN); HUNAN XIANGYI LABORATORY INSTRUMENT DEVELOPMENT CO., LTD., Changsha (CN)

( * ) Notice: Subject to any disclaimer, the term of this patent is extended or adjusted under 35 U.S.C. 154(b) by 0 days.

(21) Appl. No.: 18/758,891

(22) Filed: Jun. 28, 2024

(30) Foreign Application Priority Data

Aug. 24, 2023 (CN) ..... 202311072201.8

(51) Int. Cl.
*B22D 13/12* (2006.01)
*B22D 41/01* (2006.01)

(52) U.S. Cl.
CPC ..... *B22D 13/12* (2013.01); *B22D 41/01* (2013.01)

(58) Field of Classification Search
CPC ..... B22D 13/12; B22D 41/01; G01N 15/08
(Continued)

(56) References Cited

U.S. PATENT DOCUMENTS 3,859,843 A * 1/1975 Lowell ..... G01N 15/0886 73/866
6,021,661 A * 2/2000 Lowell ..... G01N 15/08 73/38

(Continued)

FOREIGN PATENT DOCUMENTS

WO WO-2017177268 A1 * 10/2017 ..... G01N 15/08

*Primary Examiner* — Jessee R Roe
*Assistant Examiner* — Michael Aboagye
(74) *Attorney, Agent, or Firm* — Pilloff Passino & Cosenza LLP; Rachel Pilloff; Sean Passino

(57) ABSTRACT

The application discloses a system and method for centrifugal intrusion of molten metal into porous media and then solidification positioning, including: test cups, used for placing test medium and molten metal intrusion; a rotor block, used for mounting the test cups, where one end of each test cup for placing the test medium is far away from the rotor block; a constant temperature oil bath preheating device, used for preheating the test cups and the rotor block; a centrifugal device, internally provided with the rotor block, used for performing a centrifugal operation on the test cups, where the test cups and the rotor block are installed
(Continued)

inside the centrifugal device after being preheated; and an infrared heating and compression refrigerating device, arranged inside the centrifugal device, used for controlling a temperature of the test cups.

5 Claims, 10 Drawing Sheets

(58) Field of Classification Search
USPC ..... 266/196
See application file for complete search history.

(56) References Cited

U.S. PATENT DOCUMENTS 7,040,141 B2 * 5/2006 Gupta ..... G01N 15/0826 73/38
7,059,175 B2 * 6/2006 Volfkovich ..... G01N 15/0806 73/38
7,614,279 B2 * 11/2009 Gupta ..... G01N 15/08 210/90

* cited by examiner

SYSTEM AND METHOD FOR CENTRIFUGAL INTRUSION OF MOLTEN METAL INTO POROUS MEDIA AND THEN SOLIDIFICATION POSITIONING

CROSS-REFERENCE TO RELATED APPLICATIONS

This application claims priority to Chinese Patent Application No. 202311072201.8, filed on Aug. 24, 2023, the contents of which are hereby incorporated by reference.

TECHNICAL FIELD

The application belongs to the technical field of porous media test, and in particular to a system and a method for centrifugal intrusion of molten metal into porous media and then solidification positioning.

BACKGROUND

The pore structure of porous media such as rocks, concrete and ceramics determines the physical and mechanical properties. It is of great significance to study the pore structure characteristics of porous media for ensuring the safety of rock engineering, the durability of concrete and the stability of aerospace high-performance ceramics.

However, the commonly used systems and methods for testing pore structure are limited; for example, the mercury intrusion method employs heavy metal intrusion, which is less safe and fails to obtain a three-dimensional pore structure; the low temperature liquid nitrogen method measures a small range of pore size and generally obtains only the pore information of adsorption pores in porous media; by using nuclear magnetic resonance (NMR), it is difficult to reflect the pore morphology in the pore structure, and the applicable medium is limited; electron microscope scanning only reflects the two-dimensional information of pore structure of porous media, and the obtained pore parameters are also limited; X-ray scanning is limited by the type of media, size, scanning energy and resolution, and the accuracy is currently difficult to break through the nanopore level. Such drawbacks bring great challenges to the pore structure testing of dense rocks, high-performance concrete and ceramics, making it unfavorable to the mastering of the basic properties of materials involved in deep-earth engineering and deep-space engineering. In the absence of sufficient understanding of the nanopore structure of the media, some ultra-high performance material preparations and technologies are at a standstill, making it difficult to research and develop new materials and designs for deep-earth engineering and deep-space engineering in extreme environments.

SUMMARY

The objectives of the present application include providing a system and method for centrifugal intrusion of molten metal into porous media and then solidification positioning, so as to solve the above problems.

In order to achieve the above objectives, the present application provides the following schemes.

The application relates to a system for centrifugal intrusion of molten metal into porous media and then solidification positioning, including:

test cups, used for placing test medium and molten metal intrusion;

a rotor block, used for mounting the test cups, where one end of each test cup for placing the test medium is far away from the rotor block;

a constant temperature oil bath preheating device, used for preheating the test cups and the rotor block;

a centrifugal device, internally provided with the rotor block, used for performing a centrifugal operation on the test cups, where the test cups and the rotor block are installed inside the centrifugal device after being preheated; and an infrared heating and compression refrigerating device, arranged inside the centrifugal device, used for controlling a temperature of the test cups.

Optionally, the test cup includes:

a titanium alloy test cup housing, detachably connected with the rotor block;

a detachable wedge-shaped titanium alloy pipe sleeve, coaxially penetrated in the titanium alloy test cup housing;

a pipe sleeve bottom fastening device, sleeved outside the detachable wedge-shaped titanium alloy pipe sleeve;

a pipe sleeve top fastening device, detachably connected to a top opening of the titanium alloy test cup housing, and a top end of the detachable wedge-shaped titanium alloy pipe sleeve penetrates into the pipe sleeve top fastening device;

a high-temperature resistant plastic pipe, coaxially penetrated in the detachable wedge-shaped titanium alloy pipe sleeve;

an aluminum pipe, coaxially penetrated in the high-temperature resistant plastic pipe;

wherein the molten metal intrusion is placed in the aluminum pipe; and the test medium is placed in the high-temperature resistant plastic pipe, the test medium is located at a bottom end of the high-temperature resistant plastic pipe, and a top surface of the test medium is in contact with a bottom end of the aluminum pipe and the molten metal intrusion.

Optionally, the constant temperature oil bath preheating device includes:

a test cup constant temperature oil bath preheating furnace, provided with a test cup preheating pot above; a test cup fixing device is arranged inside the test cup preheating pot, and the test cups are detachably connected with the test cup fixing device;

a rotor block constant temperature oil bath preheating furnace, provided with a rotor block preheating pot above, a rotor block fixing device is arranged inside the rotor block preheating pot, and the rotor block is detachably connected with the rotor block fixing device; and a preheating furnace control operating system, used for controlling the test cup constant temperature oil bath preheating furnace and the rotor block constant temperature oil bath preheating furnace.

Optionally, the centrifugal device includes:

an ultracentrifugal driving system, fixedly connected to an inner bottom wall of an outer housing;

a large-diameter centrifugal bin, arranged inside the outer housing and is in transmission connection with the ultracentrifugal driving system; an inlet is arranged on a top surface of the outer housing, and the inlet is correspondingly arranged at a top opening of the large-diameter centrifugal bin;

a centrifugal bin sealing cover, detachably connected to the top opening of the large-diameter centrifugal bin;

the rotor block is detachably connected to a bottom wall of the large-diameter centrifugal bin, a plurality of the test cups are detachably connected to an outer side wall of the rotor block, the plurality of the test cups are circumferentially arranged at equal intervals, and axes of the test cups face a center of the large-diameter centrifugal bin.

Optionally, the infrared heating and compression refrigerating device includes:

an annular infrared radiation heating device, sleeved on an outer side wall of the large-diameter centrifugal bin;

an annular thermal insulation layer, sleeved on an outer side wall of the annular infrared radiation heating device;

a bottom thermal insulation layer, arranged on an outer bottom wall of the large-diameter centrifugal bin;

a bottom refrigerating device, arranged between the bottom thermal insulation layer and the outer bottom wall of the large-diameter centrifugal bin; and a compression refrigerator, fixedly connected inside the outer housing and communicated with the bottom refrigerating device.

Optionally, the outer housing is further provided with:

a vacuum system, fixedly connected in the outer housing and communicated with the large-diameter centrifugal bin;

a data real-time acquisition recorder, fixedly connected in the outer housing, used for acquiring data in the large-diameter centrifugal bin; and a real-time console, used for controlling the vacuum system, the data real-time acquisition recorder, the ultracentrifugal driving system, the annular infrared radiation heating device and the compression refrigerator.

A method for using the system for centrifugal intrusion of molten metal into porous media and then solidification positioning, including the following steps:

filling samples: sequentially filling the test medium and the molten metal intrusion into the test cups;

preheating: preheating the test cups loaded with the test medium and the molten metal intrusion, and the rotor block by using the constant temperature oil bath preheating device;

centrifuging: installing the test cups on the rotor block, installing the rotor block in the centrifugal device, and performing the centrifugal operation on the test cups loaded with the test medium and the molten metal intrusion; and taking out the samples: taking out the test cups after the centrifugal operation and cooling from the centrifugal device, and repeating above steps for an another set of experiment.

Optionally, during a centrifuging process, heating an inside of the centrifugal device by the infrared heating and compression refrigerating device, and starting a time when a rotating speed of the centrifugal device rises to a set required rotating speed, and completing a molten metal intrusion after reaching a set time; and reducing the rotating speed of the centrifugal device, and at a same time, cooling an inside of the centrifugal device through the infrared heating and compression refrigerating device; when a temperature in the centrifugal device drops to a set temperature, setting the temperature in the centrifugal device to a room temperature, and stopping working after reaching a set running time.

Compared with the prior art, the application has the following advantages and technical effects.

The application provides a system and a method for centrifugal intrusion of molten metal into porous media and then solidification positioning. By centrifugalizing the non-toxic molten metal with low melting point, the molten metal invades the pores of the porous media, and then solidifies the molten metal at low temperature, so as to obtain the pore structure where the porous media invades the metal. The obtained pore structure is three-dimensional and more pore parameters may be obtained.

Compared with the prior art, the system and the method for centrifugal intrusion of molten metal into porous media and then solidification positioning may obtain a three-dimensional pore structure, and the pore size test range is large, so that the pore shape in the pore structure may be accurately reflected.

BRIEF DESCRIPTION OF THE DRAWINGS

In order to explain the embodiments of the present application or the technical schemes in the prior art more clearly, the drawings needed in the embodiments will be briefly introduced below. Obviously, the drawings in the following description are only some embodiments of the present application. For ordinary people in the field, other drawings may be obtained according to these drawings without paying creative labor.

DETAILED DESCRIPTION OF THE EMBODIMENTS

Figure 1:
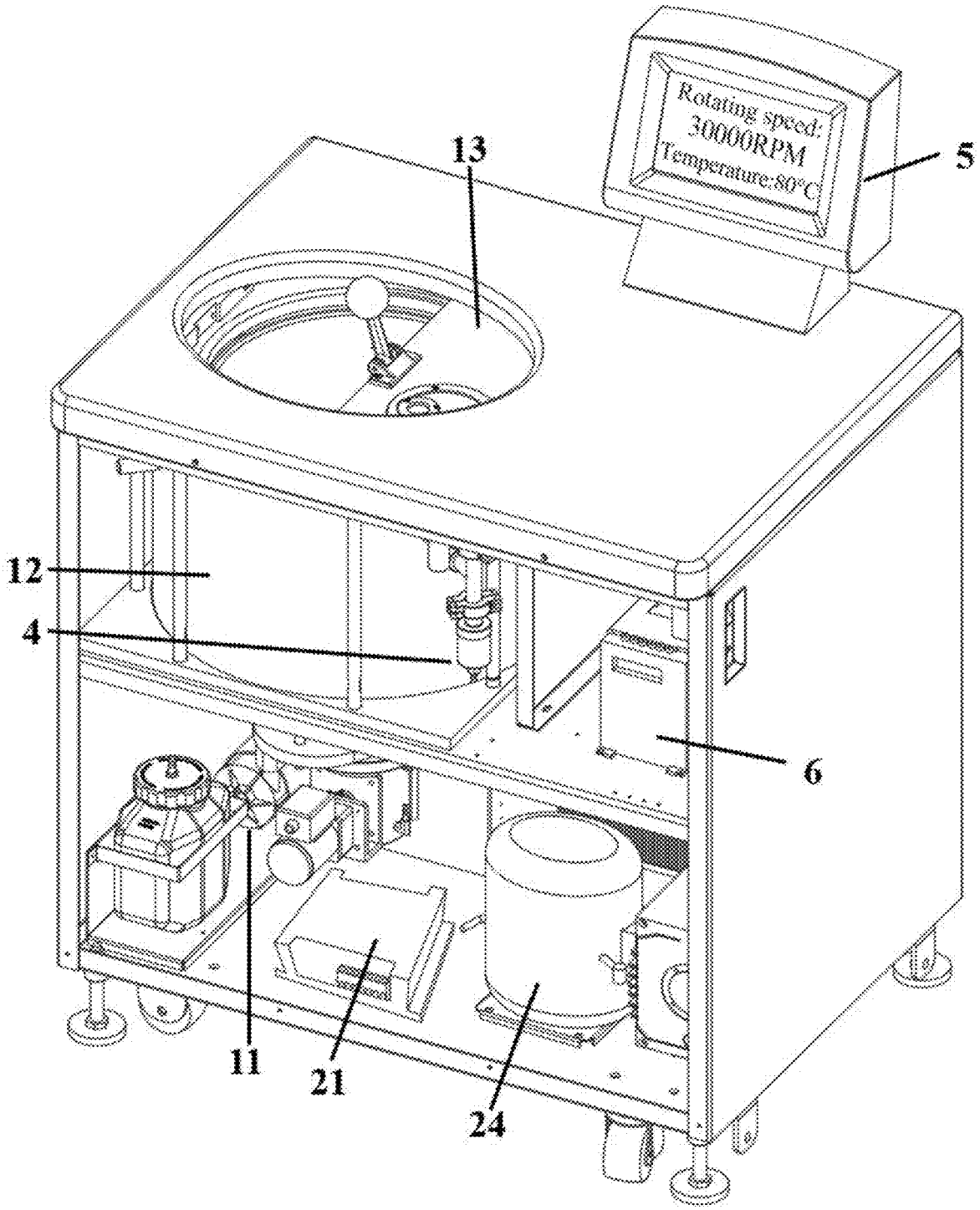
FIG. 1 is a schematic structural diagram of a centrifugal device in the present application.
Figure 2:
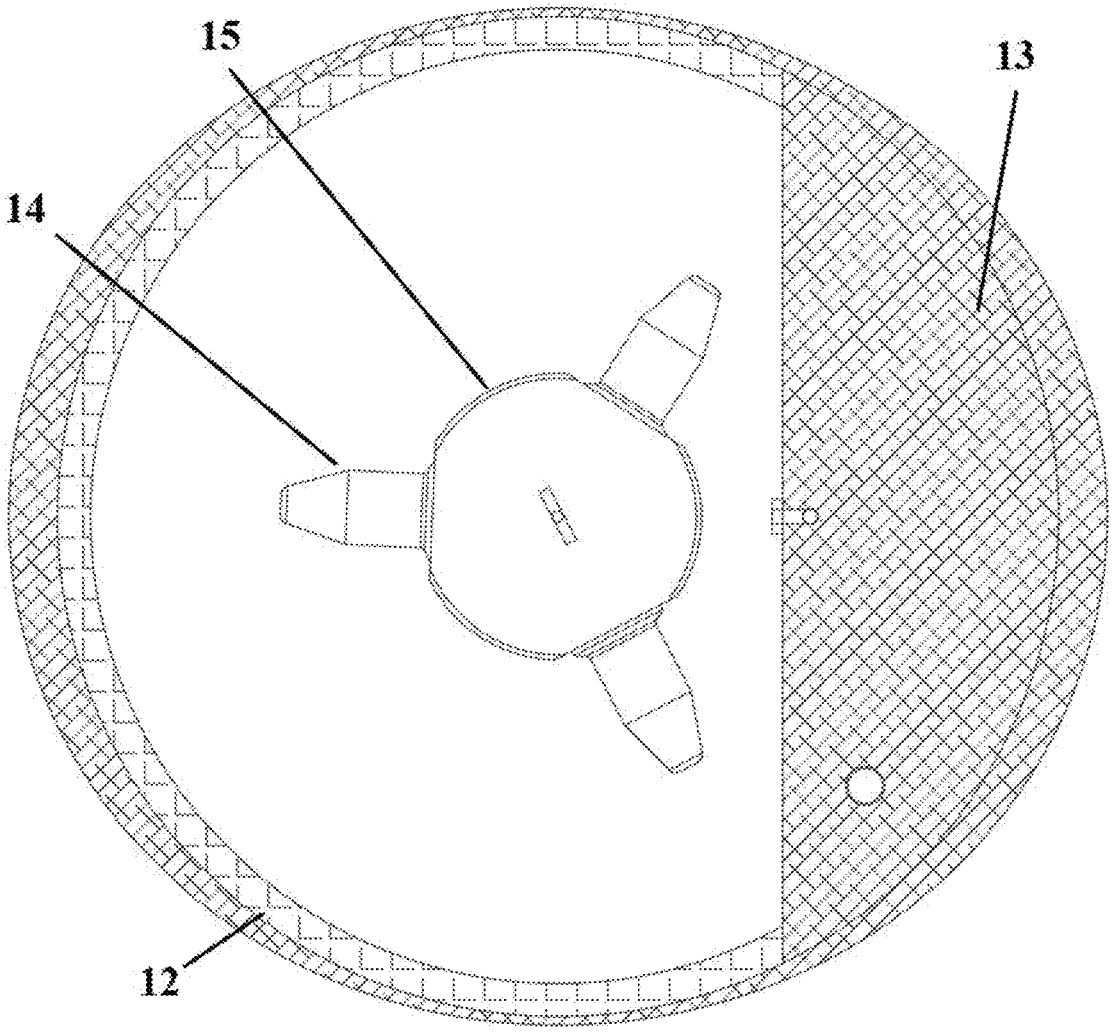
FIG. 2 shows a top view of an inlet of an outer housing in the present application.
Figure 3:
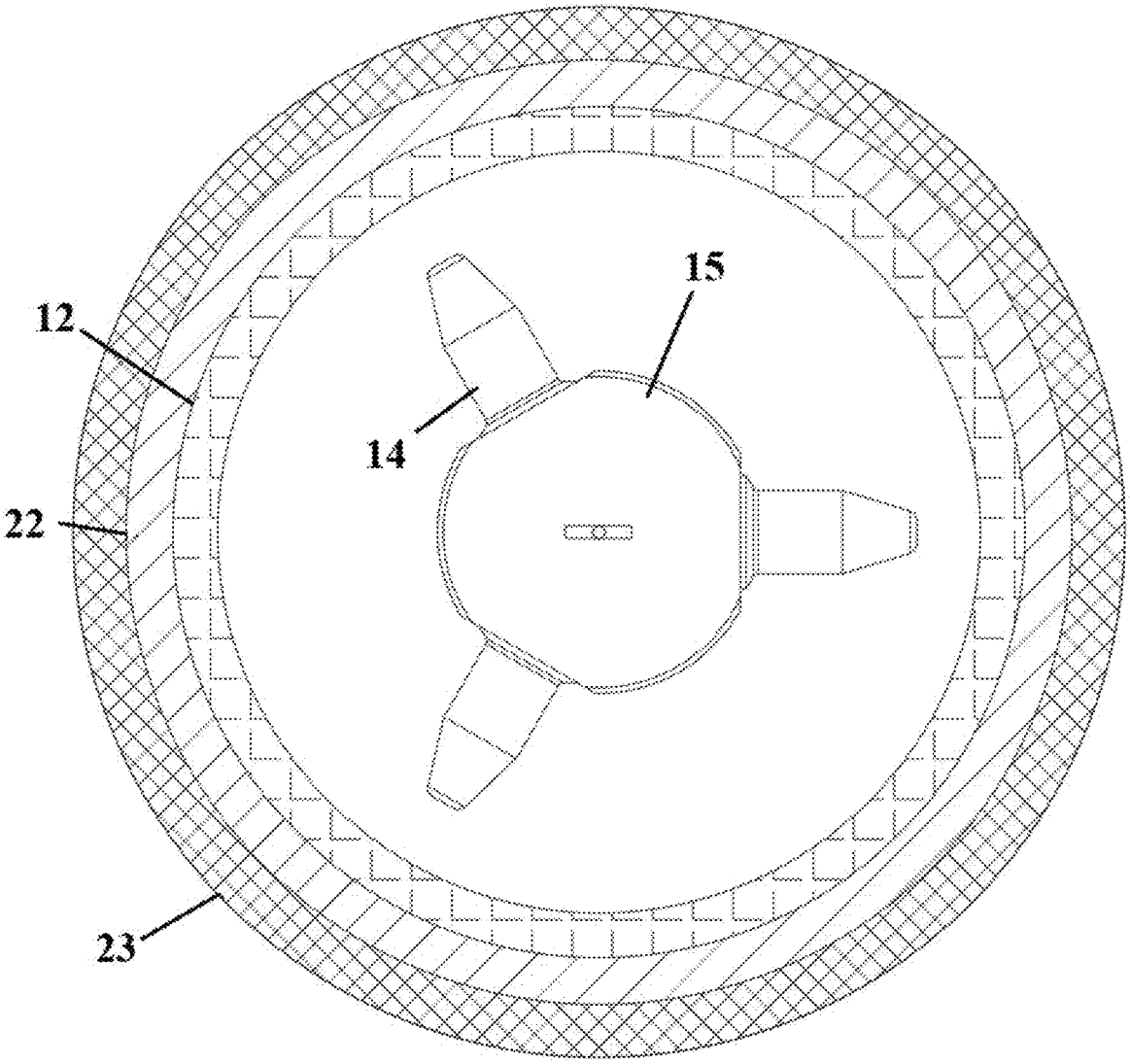
FIG. 3 is a schematic structural diagram of an annular infrared radiation heating device in the present application.
Figure 4:
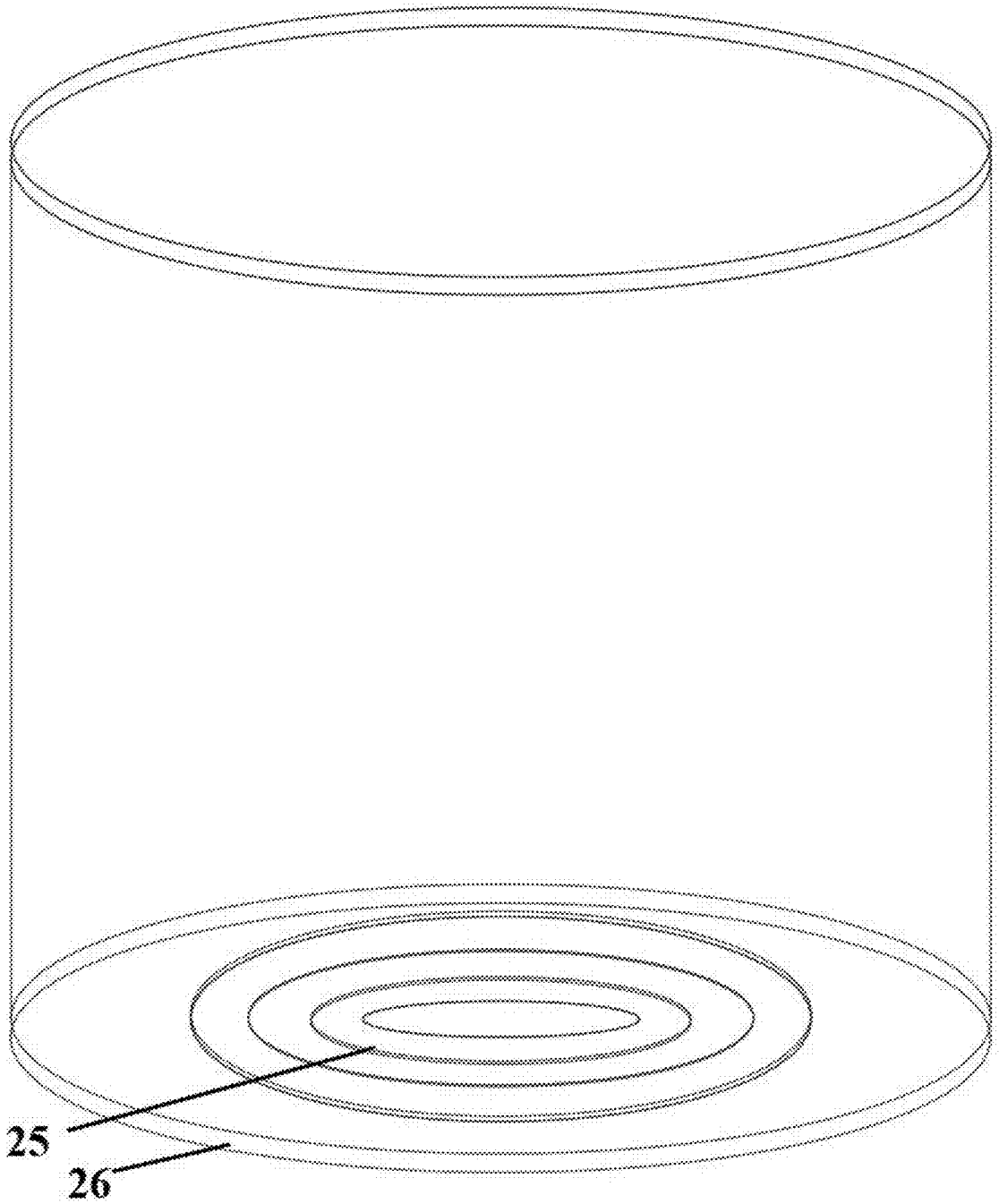
FIG. 4 is a schematic structural diagram of a bottom refrigerating device in the present application.
Figure 5:
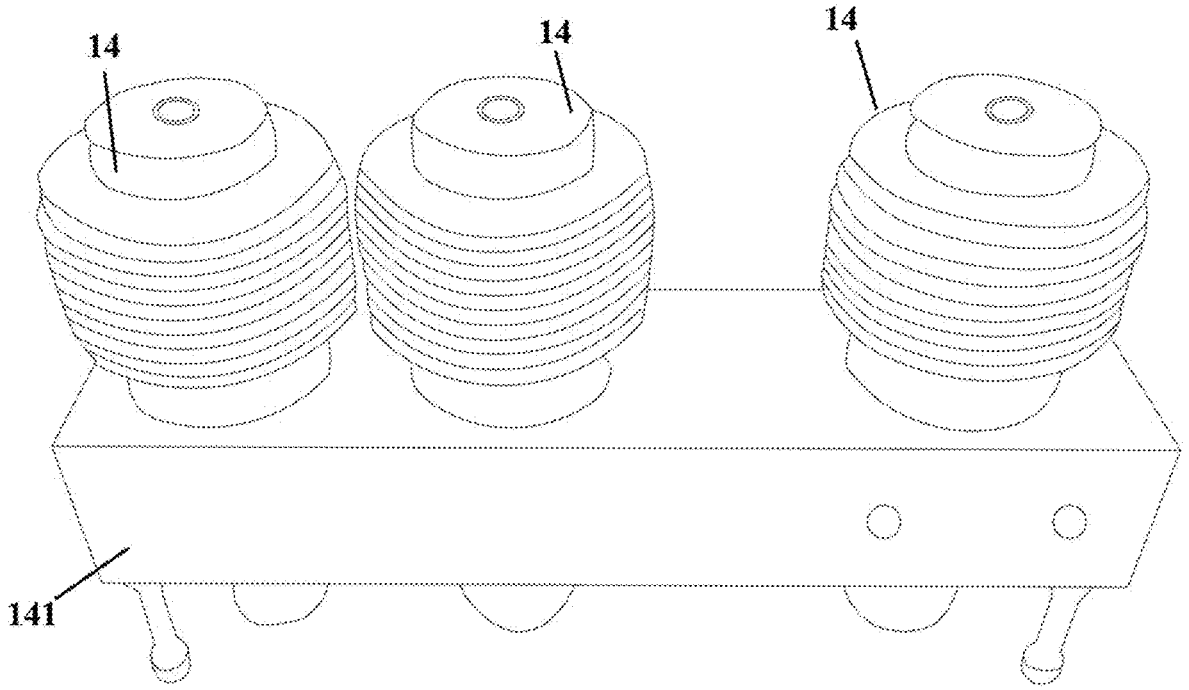
FIG. 5 is a front view of the test cup disassembling operation jig of the present application.
Figure 6:
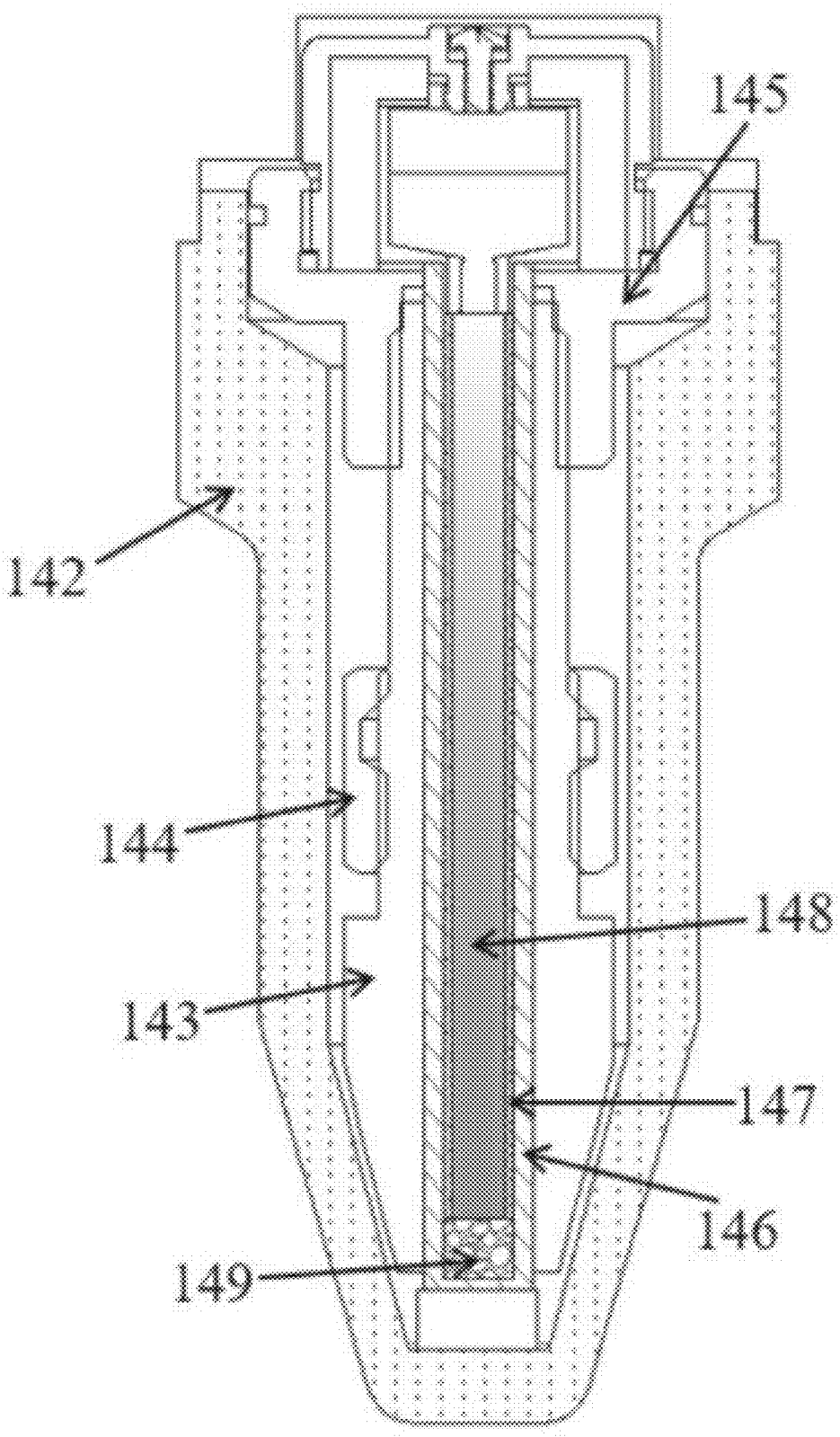
FIG. 6 is a schematic structural diagram of the test cup of the present application.
Figure 7:
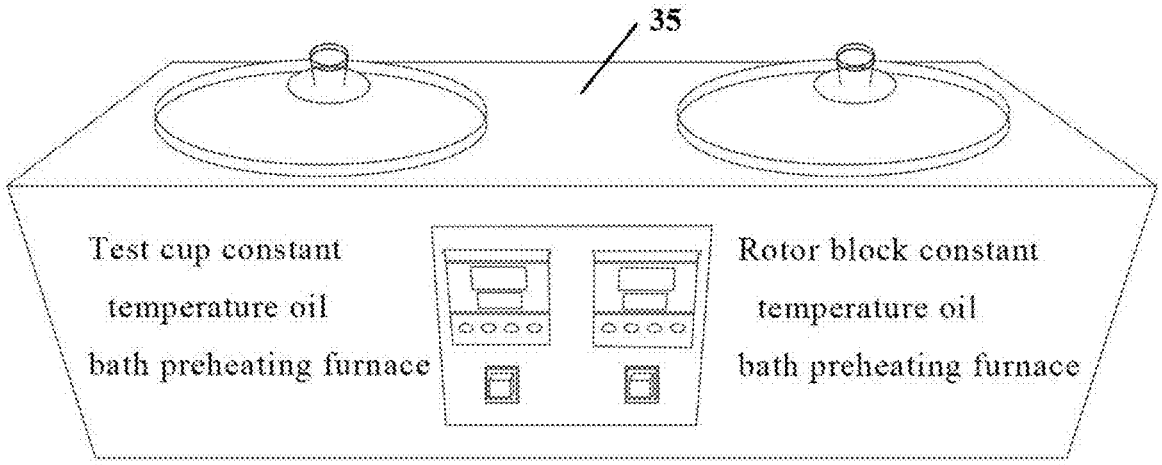
FIG. 7 is a schematic structural diagram of the constant temperature oil bath preheating device in the present application.
Figure 8:
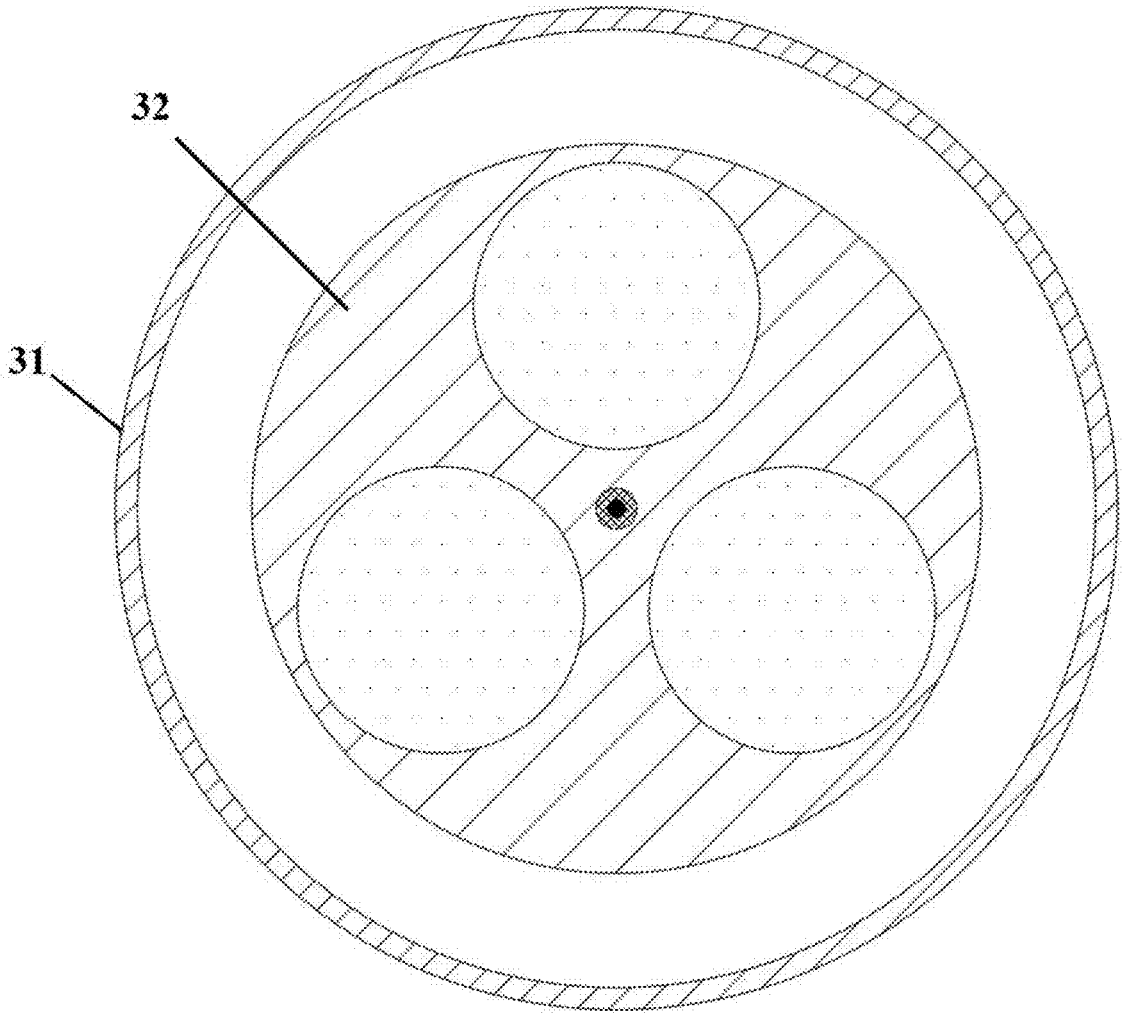
FIG. 8 is a schematic structural diagram of the test cup preheating pot in the present application.
Figure 9:
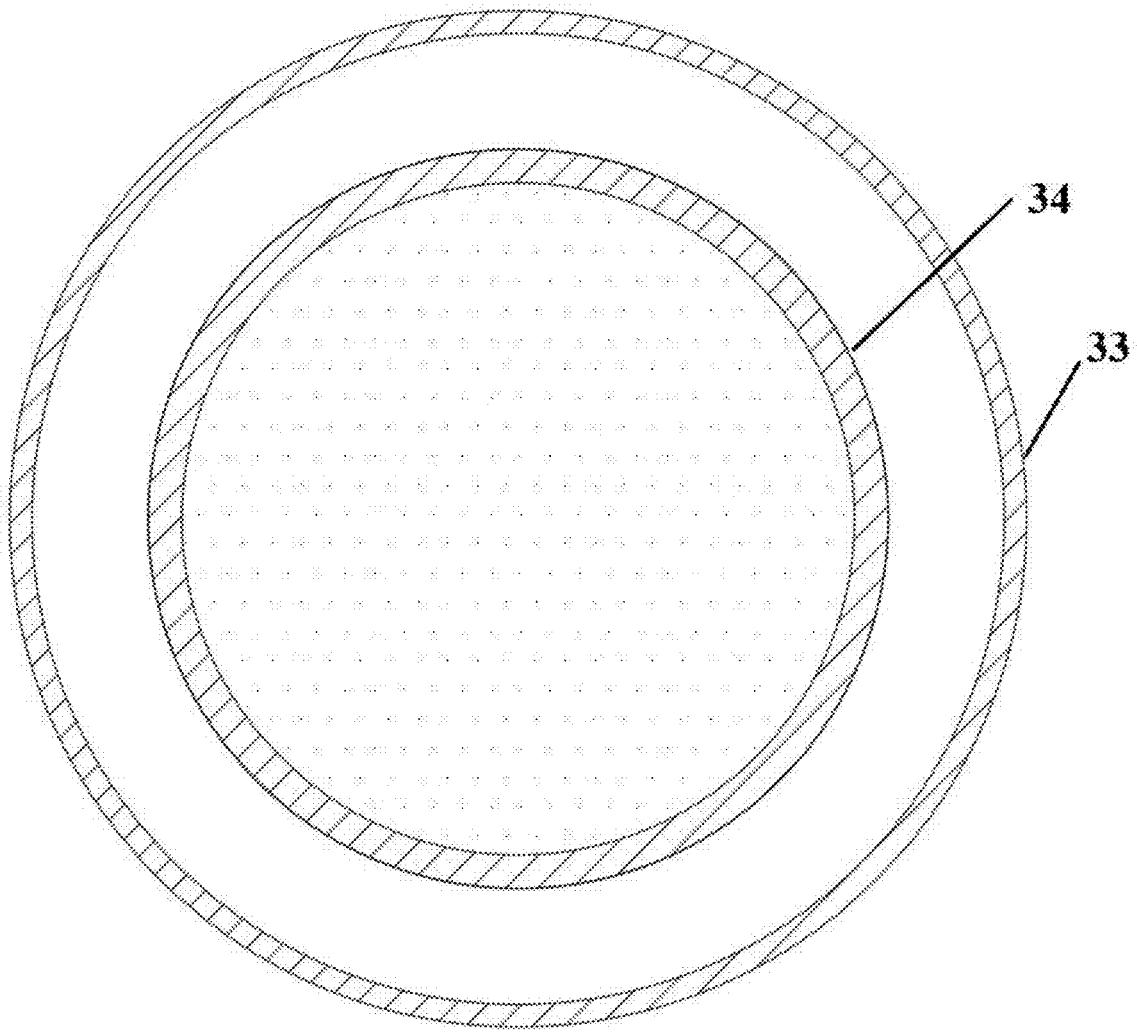
FIG. 9 is a schematic structural diagram of the rotor block preheating pot in the present application.

In the following, the technical schemes in the embodiments of the application will be clearly and completely described with reference to the attached drawings. Obviously, the described embodiments form only a part of the embodiments of the application, but not the whole embodiments. Based on the embodiments in the present application, all other embodiments obtained by ordinary technicians in the field without creative labor belong to the scope of protection of the present application.

In order to make the above objectives, features and advantages of the present application more obvious and easier to understand, the present application will be further described in detail with the attached drawings and specific embodiments.

Referring to FIG. 1-FIG. 9, the application discloses a system for centrifugal intrusion of molten metal into porous media and then solidification positioning, including:

test cups 14, used for placing test medium 149 and molten metal intrusion 148;

a rotor block 15, used for mounting the test cups 14, where one end of each test cup 14 for placing the test medium 149 is far away from the rotor block 15;

a constant temperature oil bath preheating device, used for preheating the test cups 14 and the rotor block 15;

a centrifugal device, internally provided with the rotor block 15, used for performing a centrifugal operation on the test cups 14, where the test cups 14 and the rotor block 15 are installed in the centrifugal device after being preheated; and an infrared heating and compression refrigerating device, arranged inside the centrifugal device, used for controlling a temperature of the test cups 14.

In a further optimized scheme, each of the test cups 14 includes:

a titanium alloy test cup housing 142, detachably connected with the rotor block 15;

a detachable wedge-shaped titanium alloy pipe sleeve 143, coaxially penetrated in the titanium alloy test cup housing 142;

a pipe sleeve bottom fastening device 144, sleeved outside the detachable wedge-shaped titanium alloy pipe sleeve 143;

the detachable wedge-shaped titanium alloy pipe sleeve 143 includes two symmetrically arranged half-wedge-shaped titanium alloy pipe sleeves, and the pipe sleeve bottom fastening device 144 is sleeved outside the two symmetrically arranged half-wedge-shaped titanium alloy pipe sleeves, so that the two symmetrically arranged half-wedge-shaped titanium alloy pipe sleeves form a complete detachable wedge-shaped titanium alloy pipe sleeve 143 and are fixed;

where the pipe sleeve top fastening device 145 is detachably connected to a top opening of the titanium alloy test cup housing 142, and the top end of the detachable wedge-shaped titanium alloy pipe sleeve 143 penetrates into the pipe sleeve top fastening device 145;

a high-temperature resistant plastic pipe 146, coaxially penetrated in the detachable wedge-shaped titanium alloy pipe sleeve 143;

an aluminum pipe 147, coaxially penetrated in the high-temperature resistant plastic pipe 146;

the molten metal intrusion 148, placed in the aluminum pipe 147; and the test medium 149 is placed in the high-temperature resistant plastic pipe 146, the test medium 149 is located at a bottom end of the high-temperature resistant plastic pipe 146, and a top surface of the test medium 149 is in contact with a bottom end of the aluminum pipe 147 and the molten metal intrusion 148.

In a further optimized scheme, the constant temperature oil bath preheating device includes:

a test cup constant temperature oil bath preheating furnace, provided with a test cup preheating pot 31 above, a test cup fixing device 32 is arranged in the test cup preheating pot 31, and the test cups 14 are detachably connected with the test cup fixing device 32;

a rotor block constant temperature oil bath preheating furnace, provided with a rotor block preheating pot 33 above, a rotor block fixing device 34 is arranged in the rotor block preheating pot 33, and the rotor block 15 is detachably connected with the rotor block fixing device 34; and a preheating furnace control operating system 35, used for controlling the test cup constant temperature oil bath preheating furnace and the rotor block constant temperature oil bath preheating furnace.

The preheating furnace control operating system 35 is mainly used to control and display the preheating temperature in real time, the test cup preheating pot 31 is mainly used to preheat the test cups 14 to melt the molten metal intrusion 148, and the rotor block preheating pot 33 is mainly used to preheat the rotor block 15.

Figure 10:
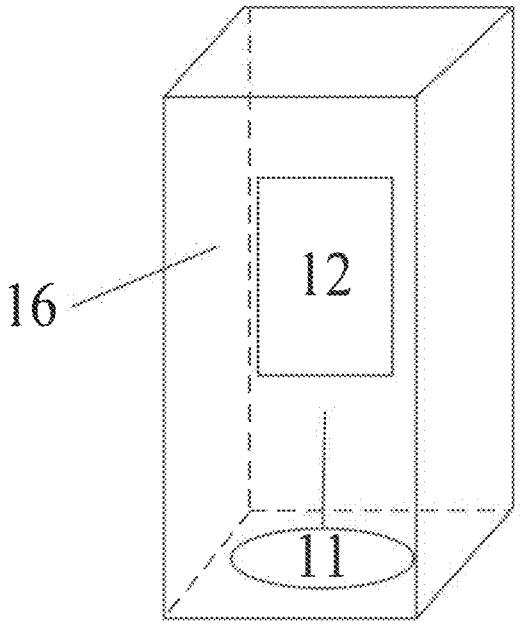
FIG. 10 is a schematic structural diagram of the centrifugal device in the present application.

In a further optimized scheme, as shown in FIG. 10, the centrifugal device includes:

an ultracentrifugal driving system 11, fixedly connected to an inner bottom wall of an outer housing 16;

the ultracentrifugal driving system 11 provides power for the centrifugal device;

a large-diameter centrifugal bin 12, arranged in the outer housing 16 and is in transmission connection with the ultracentrifugal driving system 11, and an inlet is arranged on a top surface of the outer housing 16, and the inlet is correspondingly arranged at a top opening of the large-diameter centrifugal bin 12;

a centrifugal bin sealing cover 13, detachably connected to the top opening of the large-diameter centrifugal bin 12;

the large-diameter centrifugal bin 12 and the centrifugal bin sealing cover 13 provide a vacuum environment for the test cups 14 and the rotor block 15, thus reducing the resistance caused by air during the ultra-high speed rotation.

The rotor block 15 is detachably connected to the bottom wall of the large-diameter centrifugal bin 12, and a plurality of test cups 14 are detachably connected to the outer side wall of the rotor block 15. The plurality of test cups 14 are arranged at equal intervals in the circumferential direction, and the axes of the test cups 14 face the center of the large-diameter centrifugal bin 12.

The test medium 149 is first placed at that bottom of the high-temperature resistant plastic pipe 146, then the high-temperature resistant plastic pipe 146 filled with the test medium 149 is put into the aluminum pipe 147, and then the molten metal intrusion is put into the aluminum pipe, then the detachable wedge-shaped titanium alloy pipe sleeve 143 is installed outside the high-temperature resistant plastic pipe 146, and the assembled high-temperature resistant plastic pipe 146 is fixed with the pipe sleeve bottom fastening device 144 and the pipe sleeve top fastening device 145. Finally, the assembled detachable wedge-shaped titanium alloy pipe sleeve 143 is put into the titanium alloy test cup housing 142 to complete the test cup assembly. The assembled test cups 14 and rotor block 15 are preheated separately, and then the test cups are installed on the rotor block 15, and then the whole rotor block 15 with the test cup installed after preheating is put into the large-diameter centrifugal bin 12 to complete the sample installation.

In a further optimized scheme, the infrared heating and compression refrigerating device includes:

an annular infrared radiation heating device 22, sleeved on an outer side wall of the large-diameter centrifugal bin 12, where the annular infrared radiation heating device 22 is electrically connected with an infrared heating controller 21 for controlling the annular infrared radiation heating device 22; an annular thermal insulation layer 23, sleeved on the outer side wall of the annular infrared radiation heating device 22 to provide a heat source for heating the large-diameter centrifugal bin; and a bottom thermal insulation layer 26, arranged on the outer bottom wall of the large-diameter centrifugal bin 12;

a bottom refrigerating device 25, arranged between the bottom thermal insulation layer 26 and the outer bottom wall of the large-diameter centrifugal bin 12, where the bottom refrigerating device 25 provides a cold source for the large-diameter centrifugal bin 12, and is used to cool the large-diameter centrifugal bin 12 in the solidification stage of the molten metal intrusion;

a compression refrigerator 24, fixedly connected in the outer housing and communicates with the bottom refrigerating device 25.

In a further optimized scheme, the outer housing 16 is further provided with:

a vacuum system 4, fixedly connected in the outer housing and communicated with the large-diameter centrifugal bin 12;

a data real-time acquisition recorder 6, fixedly connected in the outer housing, used for acquiring data in the large-diameter centrifugal bin 12; and a real-time console 5, used for controlling the vacuum system 4, the data real-time acquisition recorder 6, the ultracentrifugal driving system 11, the annular infrared radiation heating device 22 and the compression refrigerator 24.

A method for using the system for centrifugal intrusion of molten metal into porous media and then solidification positioning includes the following steps:

filling samples: sequentially filling the test medium 149 and the molten metal intrusion 148 into the test cups 14;

preheating: preheating the test cups 14 loaded with the test medium 149 and the molten metal intrusion 148, and the rotor block 15 by using the constant temperature oil bath preheating device;

centrifuging: installing the test cups 14 on the rotor block 15, installing the rotor block 15 in the centrifugal device, and performing the centrifugal operation on the test cups 14 loaded with the test medium 149 and the molten metal intrusion 148; and taking out the samples: taking out the test cups 14 after the centrifugal operation and cooling from the centrifugal device, and repeating above steps for an another set of experiment.

In a further optimized scheme, during a centrifuging process, an inside of the centrifugal device is heated by the infrared heating and compression refrigerating device, and a time is started when a rotating speed of the centrifugal device rises to a set required rotating speed, and a molten metal intrusion is completed after reaching a set time; and the rotating speed of the centrifugal device is reduced, and at a same time, an inside of the centrifugal device is cooled through the infrared heating and compression refrigerating device;

when a temperature in the centrifugal device drops to a set temperature, the temperature is set in the centrifugal device to a room temperature, and work is stopped after reaching a set running time.

One concrete embodiment includes:

S1, sample installation: firstly, the test medium 149 is put at the bottom of the high-temperature resistant plastic pipe 146, then the high-temperature resistant plastic pipe 146 filled with the test medium 149 is put into the aluminum pipe 147, then the molten metal intrusion 148 is put in the aluminum pipe, then the detachable wedge-shaped titanium alloy pipe sleeve 143 is installed outside the high-temperature resistant plastic pipe 146, and the assembled high-temperature resistant plastic pipe 146 is fixed with the pipe sleeve bottom fastening device 144 and the pipe sleeve top fastening device 145; finally, the assembled detachable wedge-shaped titanium alloy pipe sleeve 143 is put into the titanium alloy test cup housing 142 to complete the sample installation. In the process of sample installation, it is necessary to pay attention to the consistency of the weights of the three test cups after installing the sample, and the deviation is within the range of ±0.1 g;

S2, preheating of test equipment: firstly, the preheating furnace control operating system 35 is used to set the preheating temperature of the test cup preheating pot 31 and the rotor block preheating pot 33 respectively; then, the detachable wedge-shaped closed titanium alloy ultra-high strength fatigue-resistant and high-temperature resistant test cup 14 and titanium alloy ultra-high strength fatigue-resistant and high-temperature resistant rotor block 15 are respectively put into the test cup fixing device 32 and the rotor block fixing device 34; meanwhile, the temperature of the large-diameter centrifugal bin is set by using the real-time console 5 to preheat the centrifugal bin;

S3, invading molten metal and solidifying and positioning: the preheated detachable wedge-shaped closed titanium alloy ultra-high strength fatigue-resistant and high-temperature resistant test cup 14 and the titanium alloy ultra-high strength fatigue-resistant and high-temperature resistant rotor block 15 are taken out, and the titanium alloy ultra-high strength fatigue-resistant and high-temperature resistant test cup 14 is installed on the titanium alloy ultra-high strength fatigue-resistant and high-temperature resistant rotor block 15; the centrifugal bin sealing cover 13 is opened, and then the whole rotor block 15 with the test cup installed after preheating is put into the large-diameter centrifugal bin 12, the centrifugal bin sealing cover 13 is closed, and then the real-time console 5 is used to set the rotating speed, time and temperature required for the test; at this time, the ultracentrifugal driving system 11 starts to accelerate, and at the same time, the vacuum system 4 is initiated; when the rotating speed rises to the set required rotating speed, the time is started, and after the time reaches the set time, the molten metal intrusion is completed; then, the real-time console 5 is used to set a lower fixed rotating speed, running time and lower temperature of the centrifugal bin, and at this time, the ultracentrifugal driving system 11 starts to decelerate, while the vacuum system 4 stops working, and the temperatures of the centrifugal bin wall, rotor block and test cup gradually decrease. When the temperature of the large-diameter centrifugal bin 12 drops to the set temperature, the set temperature is room temperature. When the set running time is reached, the ultracentrifugal driving system 11 decelerates to 0 again, and metal solidification is completed;

S4, taking out the sample: after the metal is solidified, the centrifugal bin sealing cover 13 is opened, the titanium alloy ultra-high strength fatigue-resistant and high-temperature resistant rotor block 15 is taken out, and the test sample is taken out by using the test cup disassembling operation jig 141 to complete the experiment, the test cup disassembling operation jig 141 is used to place the test cup 14;

S5, repeating the experimental steps S1-S4, and then carrying out next group of experiment of media molten metal intrusion and solidification.

The formula for calculating the intrusion pressure is: $P=1/2\rho\omega 2\ (2L_1H+H^2)/10^9$;

the melting point of molten metal intrusion is as low as 35-70° C.;

where P is the intrusion pressure;

ρ is the density of the intrusion agent (liquid metal), optionally 8-8.2 g/cm$^3$;

ω2 is the square of angular velocity; ω2-2πn/60;

the centrifugal radius L of the interface between the intrusion agent and the porous substrate sample: 150 mm; $L_1$: the minimum distance between the liquid level of the intrusion agent and the rotation center ($L_1$=L−H);

the liquid column length H of the intrusion agent (liquid metal) is 100 mm;

when the centrifugal speed reaches n=30000 r/min, the intrusion pressure is:

$$P=1/2\rho\omega 2(2L_1H+H^2)/10^9$$

$$P=1/2*8*(2\pi n/60)^2*(2*50*100+100^2)/10^9=809.3\ (MPa).$$

In the description of the present application, it should be understood that the orientation or positional relationships indicated by the terms "longitudinal", "transverse", "upper", "lower", "front", "rear", "left", "right", "vertical", "horizontal", "top", "bottom", "inner", "outer" are based on the orientation or positional relationship shown in the drawings are only for the convenience of describing the application, rather than indicating or implying that the device or element referred to must have a specific orientation, be constructed and operated in a specific orientation, and therefore cannot be understood as a limitation to the application.

The above-mentioned embodiments only describe the preferred mode of the application, and do not limit the scope of the application. Under the premise of not departing from the design spirit of the application, various modifications and improvements made by ordinary technicians in the field to the technical scheme of the application shall fall within the protection scope determined by the claims of the application.

What is claimed is:

1. A system for centrifugal intrusion of molten metal into porous media, comprising:

test cups, for receiving test medium and molten metal intrusion agent;

a rotor block, of which the test cups are mounted on a surface, wherein one end of each test cup for placing the test medium is away from the rotor block;

a constant temperature oil bath preheating device, used for preheating the test cups and the rotor block;

a centrifugal device, internally provided with the rotor block, used for performing a centrifugal operation on the test cups, wherein the test cups and the rotor block are installed inside the centrifugal device after being preheated; and an infrared heating and compression refrigerating device, arranged inside the centrifugal device, used for controlling a temperature of the test cups;

the test cup comprises:

a titanium alloy test cup housing, detachably connected with the rotor block;

a detachable wedge-shaped titanium alloy pipe sleeve, coaxially penetrated in the titanium alloy test cup housing;

a pipe sleeve bottom fastening device, sleeved outside the detachable wedge-shaped titanium alloy pipe sleeve;

a pipe sleeve top fastening device, detachably connected to a top opening of the titanium alloy test cup housing, and a top end of the detachable wedge-shaped titanium alloy pipe sleeve penetrates into the pipe sleeve top fastening device;

a high-temperature resistant plastic pipe, coaxially penetrated in the detachable wedge-shaped titanium alloy pipe sleeve, an aluminum pipe, coaxially penetrated in the high-temperature resistant plastic pipe;

the molten metal intrusion agent, placed in the aluminum pipe; and the test medium is placed in the high-temperature resistant plastic pipe, the test medium is located at a bottom end of the high-temperature resistant plastic pipe, and a top surface of the test medium is in contact with a bottom end of the aluminum pipe and the molten metal intrusion agent;

the constant temperature oil bath preheating device comprises:

a test cup constant temperature oil bath preheating furnace, provided with a test cup preheating pot above; a test cup fixing device is arranged inside the test cup preheating pot, and the test cups are detachably connected with the test cup fixing device;

a rotor block constant temperature oil bath preheating furnace, provided with a rotor block preheating pot above, a rotor block fixing device is arranged inside the rotor block preheating pot, and the rotor block is detachably connected with the rotor block fixing device; and a preheating furnace control operating system, used for controlling the test cup constant temperature oil bath preheating furnace and the rotor block constant temperature oil bath preheating furnace;

the centrifugal device comprises:

an ultracentrifugal driving system, fixedly connected to an inner bottom wall of an outer housing;

a large-diameter centrifugal bin, arranged inside the outer housing and is in transmission connection with the ultracentrifugal driving system, and an inlet is arranged on a top surface of the outer housing, and the inlet is correspondingly arranged at a top opening of the large-diameter centrifugal bin;

a centrifugal bin sealing cover, detachably connected to the top opening of the large-diameter centrifugal bin;

the rotor block is detachably connected to a bottom wall of the large-diameter centrifugal bin, a plurality of the test cups are detachably connected to an outer side wall of the rotor block, the plurality of the test cups are circumferentially arranged at equal intervals, and axes of the test cups face a center of the large-diameter centrifugal bin.

2. The system according to claim 1, wherein the infrared heating and compression refrigerating device comprises:

an annular infrared radiation heating device, sleeved on an outer side wall of the large-diameter centrifugal bin;

an annular thermal insulation layer, sleeved on an outer side wall of the annular infrared radiation heating device;

a bottom thermal insulation layer, arranged on an outer bottom wall of the large-diameter centrifugal bin;

a bottom refrigerating device, arranged between the bottom thermal insulation layer and the outer bottom wall of the large-diameter centrifugal bin; and a compression refrigerator, fixedly connected inside the outer housing and communicated with the bottom refrigerating device.

3. The system according to claim 2, wherein the outer housing is further provided with:

a vacuum system, fixedly connected in the outer housing and communicated with the large-diameter centrifugal bin;

a data real-time acquisition recorder, fixedly connected in the outer housing, used for acquiring data in the large-diameter centrifugal bin; and a real-time console, used for controlling the vacuum system, the data real-time acquisition recorder, the ultracentrifugal driving system, the annular infrared radiation heating device and the compression refrigerator.

4. A method of using the system for centrifugal intrusion of molten metal into porous media according to claim 1, comprising the following steps:

filling samples: sequentially filling the test medium and the molten metal intrusion agent into the test cups;

preheating: preheating the test cups loaded with the test medium and the molten metal intrusion agent, and the rotor block by using the constant temperature oil bath preheating device;

centrifuging: installing the test cups on the rotor block, installing the rotor block in the centrifugal device, and performing the centrifugal operation on the test cups loaded with the test medium and the molten metal intrusion agent; and taking out the samples: taking out the test cups after the centrifugal operation and cooling from the centrifugal device, and repeating above steps for an another set of experiment.

5. The method according to claim 4, wherein during a centrifuging process, heating an inside of the centrifugal device by the infrared heating and compression refrigerating device, and starting a time when a rotating speed of the centrifugal device rises to a set required rotating speed, and completing a molten metal intrusion agent after reaching a set time; and reducing the rotating speed of the centrifugal device, and at a same time, cooling an inside of the centrifugal device through the infrared heating and compression refrigerating device; when a temperature in the centrifugal device drops to a set temperature, setting the temperature in the centrifugal device to a room temperature, and stopping the centrifugal device from working after reaching a set running time.

* * * * *